US008325102B2

(12) United States Patent
Gianvittorio

(10) Patent No.: US 8,325,102 B2
(45) Date of Patent: Dec. 4, 2012

(54) SINGLE SHEET PHASED ARRAY

(75) Inventor: John P. Gianvittorio, Venice, CA (US)

(73) Assignee: Raytheon Company, Waltham, MA (US)

( * ) Notice: Subject to any disclaimer, the term of this patent is extended or adjusted under 35 U.S.C. 154(b) by 538 days.

(21) Appl. No.: 12/606,939

(22) Filed: Oct. 27, 2009

(65) Prior Publication Data

US 2011/0095945 A1 Apr. 28, 2011

(51) Int. Cl.
*H01Q 3/02* (2006.01)

(52) U.S. Cl. ..... 343/882; 343/700 MS; 343/770; 343/881

(58) Field of Classification Search ..... 343/700, 343/767, 770, 853, 881, 882
See application file for complete search history.

(56) References Cited

U.S. PATENT DOCUMENTS

| | | | | |
|---|---|---|---|---|
| 5,313,221 | A | 5/1994 | Denton, Jr. | |
| 5,646,635 | A * | 7/1997 | Cockson et al. | 343/702 |
| 6,348,897 | B1 * | 2/2002 | Alameh et al. | 343/702 |
| 6,476,773 | B2 * | 11/2002 | Palmer et al. | 343/795 |
| 6,774,852 | B2 * | 8/2004 | Chiang et al. | 343/700 MS |
| 7,057,563 | B2 | 6/2006 | Cox et al. | |

* cited by examiner

*Primary Examiner* — Tho G Phan
(74) *Attorney, Agent, or Firm* — Christie, Parker & Hale, LLP

(57) ABSTRACT

A single sheet phased array includes a flexible dielectric substrate having a first surface and an oppositely facing second surface, and a first conductive layer on the first surface and a second conductive layer on the second surface. The flexible dielectric substrate, the first conductive layer and the second conductive layer are patterned to form at least one feed network and a plurality of radiators directly coupled to the at least one feed network. Further, the plurality of radiators are pivotable with respect to the flexible dielectric substrate to be positioned in a direction away from the first surface or the second surface of the flexible dielectric substrate when the single sheet phased array is deployed.

11 Claims, 2 Drawing Sheets

SINGLE SHEET PHASED ARRAY

BACKGROUND OF THE INVENTION

The present invention relates to phased arrays, and, more particularly, light weight phased arrays.

A phased array (or phased array antenna) is used in a wide variety of applications. As one example, the phased array may be deployed in a space-based application such as on a satellite to provide communication with ground stations on earth. For such space-based applications, it is desirable that the phased array be relatively light in weight and simple in its construction. In another example, the phased array may be deployed in military applications in which light weight and simple construction for enhanced ruggedness, and the ability to be easily deployed, are desirable.

Previous efforts to provide a light weight phased array are described in U.S. Pat. No. 5,313,221, which discloses a phased array monopole antenna that has a single layer membrane upon which a plurality of antenna units are attached. However, the antenna units are attached to the single layer membrane with screws, increasing complexity and weight of the assembly.

A foldable radiator assembly is disclosed in U.S. Pat. No. 7,057,563, which discloses a foldable radiator assembly that includes a flexible dielectric substrate structure having a radiator conductor pattern formed therein. However, this foldable radiator assembly does not include phase shifters constructed out of the same flexible dielectric substrate structure. Furthermore, a feed network is externally provided, not incorporated in the same flexible dielectric substrate structure. The entire disclosure of each of the above referenced patents is hereby incorporated by reference.

Therefore, it is desirable to provide a phased array that is relatively light weight and simple in construction.

SUMMARY OF THE INVENTION

Aspects of exemplary embodiments of the present invention are directed toward a phased array that is relatively light weight and simple in construction. Other aspects of the exemplary embodiments of the present invention are directed toward a phased array that includes radiators and phase shifters coupled directly to a feed network without vias or feeding pins.

According to an embodiment of the present invention, a single sheet phased array includes: a flexible dielectric substrate having a first surface and an oppositely facing second surface, a first conductive layer on the first surface and a second conductive layer on the second surface. The flexible dielectric substrate, the first conductive layer and the second conductive layer are patterned to form at least one feed network and a plurality of radiators directly coupled to the at least one feed network, and the plurality of radiators may be pivotable with respect to the flexible dielectric substrate for positioning in a direction away from the first surface or the second surface of the flexible dielectric substrate when the single sheet phased array is deployed.

According to an embodiment of the present invention, the at least one feed network may include a plurality of phase shifters.

According to an embodiment of the present invention, components of the plurality of phase shifters may include patterned portions of the first conductive layer and/or the second conductive layer.

According to an embodiment of the present invention, the plurality of phase shifters may be offset co-planar waveguide phase shifters.

According to an embodiment of the present invention, components of each of the offset co-planar waveguide phase shifters may include at least one capacitive component, at least one inductive component and a waveguide.

According to an embodiment of the present invention, the at least one feed network may include a first feed network and a second feed network.

According to an embodiment of the present invention, a first group of the plurality of radiators may be coupled to the first feed network and a second group of the plurality of radiators may be coupled to the second feed network.

According to an embodiment of the present invention, a first group of the plurality of phase shifters may be coupled to the first feed network and a second group of the plurality of phase shifters may be coupled to the second feed network.

According to an embodiment of the present invention, a polarization of the first group of the radiators is different from that of the second group of the radiators.

According to an embodiment of the present invention, the at least one feed network may include a plurality of branch feeds extending in parallel.

According to an embodiment of the present invention, the plurality of phase shifters may be divided into groups, and the phase shifters of each of the groups may be serially coupled to each other via a corresponding one of the plurality of branch feeds.

According to an embodiment of the present invention, the plurality of radiators may be notch radiators.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1A:
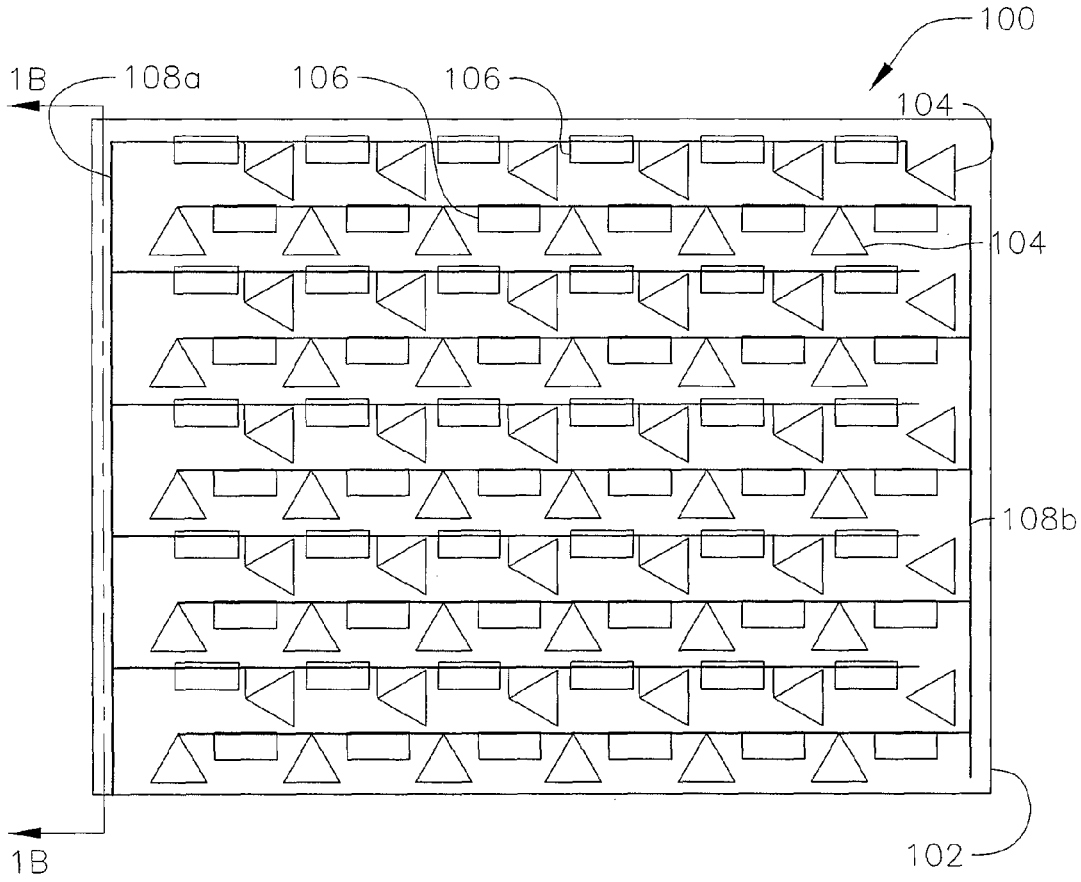
FIG. 1*a* is a conceptual block diagram showing a plan view of a single sheet phased array according to an embodiment of the present invention.

In the following detailed description, only certain exemplary embodiments of the present invention are shown and described, by way of illustration. As those skilled in the art would recognize, the present invention may be embodied in many different forms and should not be construed as being limited to the embodiments set forth herein. Also, in the context of the present application, when an element is referred to as being "on" another element, it can be directly on the another element or be indirectly on the another element with one or more intervening elements interposed therebetween. Like reference numerals designate like elements throughout the specification. When an element is referred to as being "coupled to" or "connected to" other element, it can be directly connected to the other element, or it can be connected to the other element with one or more other elements in-between.

Exemplary embodiments of the present invention are directed toward a very low mass phased array design suitable for space based applications such as micro-satellite radar applications. Very low mass phased array designs such as ultra-lightweight (ULW) aperture arrays are a key enabler in space based applications. To construct a very large (10 $m^2$ or larger) ULW aperture array, novel feeding networks are required to eliminate or reduce vias and feeding pins which add weight to the ULW aperture array. Exemplary embodiments of the present invention enable the ULW aperture array to be constructed without connecting via and feeding pin, therefore, the ULW aperture array can be designed to be very robust and lightweight.

Furthermore, the exemplary embodiments of the present invention enable a phased array to integrally incorporate a plurality of tuned filters (e.g., phase shifters) in the feed network to achieve the correct phasing at each of the radiators of the phased array without using vias or feeding pins. In addition, exemplary embodiments of the present invention enable the phased array to include fold-out radiators that require no connecting vias or feeding pins between the radiators and the feed network.

Accordingly, exemplary embodiments of the present invention can facilitate the design and construction of an ultra-light weight phased array, e.g., in conformal configurations and space based applications.

Hereinafter, exemplary embodiments of the present invention will be described in more detail in reference to the figures of the drawings.

Figure 1B:
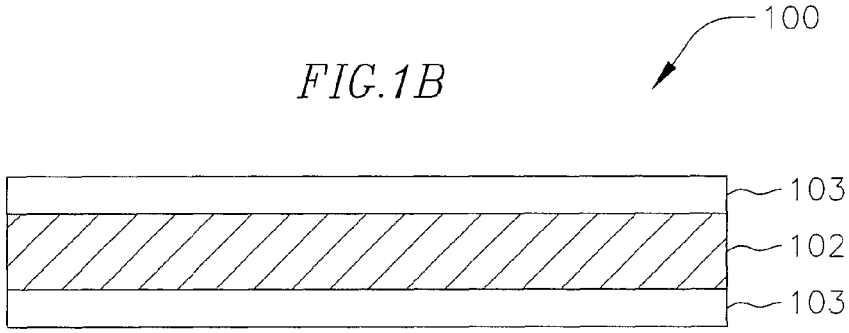
FIG. 1*b* is a cross sectional view of the single sheet phased array of FIG. 1*a* along the line 1B-1B.

FIG. 1*a* is a conceptual block diagram showing a plan view of a single sheet phased array according to an embodiment of the present invention. FIG. 1*b* is a cross sectional view of the single sheet phased array of FIG. 1*a* along the line 1B-1B.

Referring to FIGS. 1*a* and 1*b*, a single sheet phased array 100 is constructed from a layered structure including a single layer of flexible dielectric substrate 102 (e.g., Kapton sheet or other suitable LCP dielectrics) and conductive layers 103 (e.g., metal layers) provided on respective top and bottom surfaces of the flexible dielectric substrate 102. The flexible dielectric substrate 102 and the conductive layers 103 are patterned to form a plurality of radiators 104, a plurality of phase shifters 106 and a feed network, 108*a* and 108*b*. The above described features can be patterned by suitable printed circuit board methods or other known methods in the art. As described above, the radiators 104, the phase shifters 106 and the feed network, 108*a* and 108*b*, are all patterned from the same flexible dielectric substrate 102 and conductive layers 103. Furthermore, the feed network, 108*a* and 108*b*, is provided on a single layer; therefore, no transition pins or vias are required for connecting the radiators 104, the phase shifters 106 and the feed network, 108*a* and 108*b*, together. After the radiators 104 are patterned, they are flap-like structures such that only one side of each radiators 104 remains in connection with the rest of the layered structure including the flexible dielectric substrate 102 between the conductive layers 103. Because the flexible dielectric substrate 102 and the conductive layers 103 are all flexible, the radiators 104 can be folded out like flaps (i.e., pivotable) to point away from the surface of the flexible dielectric substrate 102 when the single sheet phased array 100 is deployed. In addition, in one embodiment, the radiators 104 connected to the feed network 108*a* and the radiators 104 connected to the feed network 108*b* have different polarizations by positioning the radiators 104 at different orientations. For example, the radiators 104 connected to the feed network 108*a* and the radiators 104 connected to the feed network 108*b* may be patterned to be pivotable in different directions.

Figure 1C:
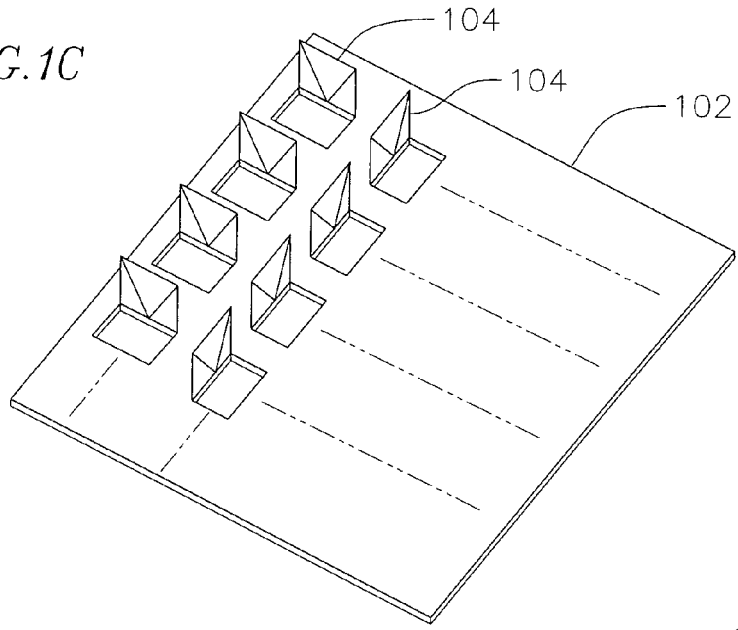
FIG. 1*c* is a conceptual drawing showing a perspective view of the single sheet phased array of FIG. 1*a* with the radiators in deployed position.

FIG. 1*c* is a conceptual drawing showing a perspective view of the single sheet phased array of FIG. 1*a* with the radiators in deployed positions. In FIG. 1*c*, the radiators 104 are shown to be positioned in a direction away from the flexible dielectric substrate 102. For ease of illustration and better understanding, the feed network, 108*a* and 108*b*, and the phased shifters 106 are omitted in FIG. 1*c*.

Figure 2:
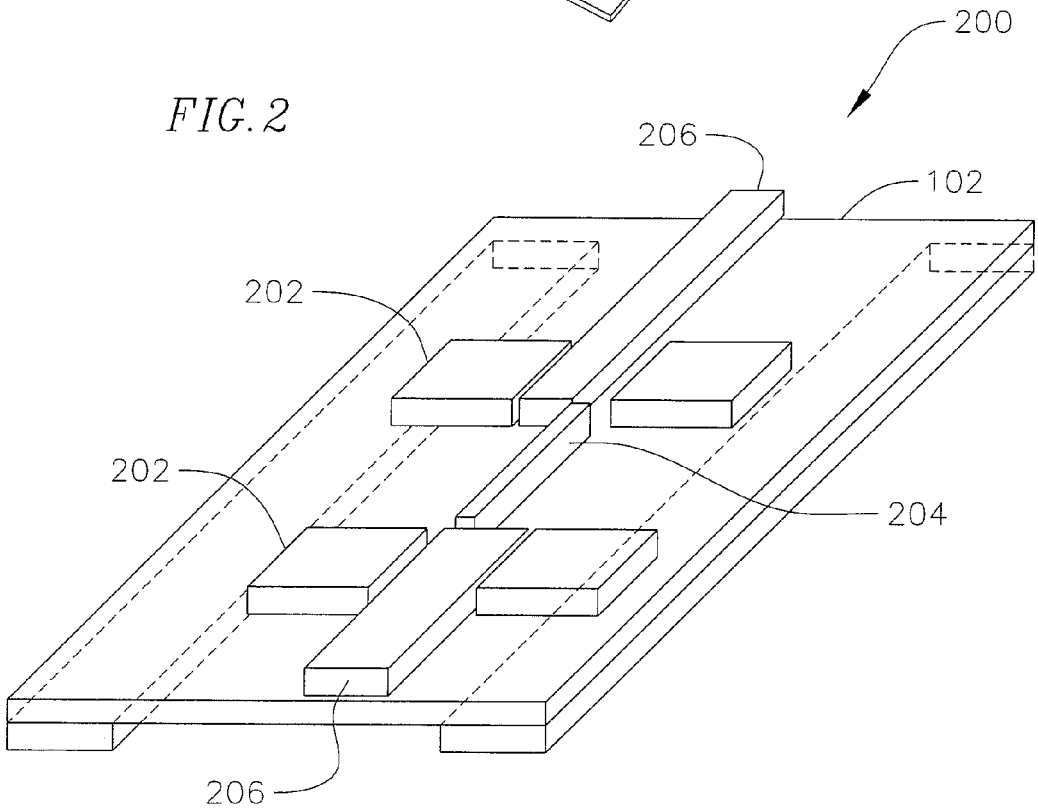
FIG. 2 is a perspective view of a phase shifter shown in FIG. 1*a* according to an embodiment of the present invention.

FIG. 2 is a perspective view of a phase shifter shown in FIG. 1*a* according to an embodiment of the present invention.

Referring to FIG. 2, the phase shifter is an offset coplanar waveguide (CPW) phase shifter 200. Layers corresponding to the conductive layers 103 of FIGS. 1*a* and 1*b* are patterned to form components of the CPW phase shifter 200 on the top and bottom surfaces of the flexible dielectric substrate 102. The components include, but not limited to, a capacitive component 202, an inductive component 204 and a waveguide 206. The structure corresponding to the plurality of phase shifters 106 of FIG. 1*a*, e.g., the CPW phase shifter 200, are integrally formed with the feed network, 108*a* and 108, and the radiators 104, therefore, the single layer phased array 100 can be provided with a reduced number (or absence) of vias or feeding pins to interconnect the radiators 104, the phase shifters 106 and the feed network, 108*a* and 108*b*, together.

The embodiments shown in the above-described drawings are not limited to the particular dimensions shown in the drawings. One skilled in the pertinent art would be able to appreciate that the embodiments can be adapted to other suitable sizes and shapes.

According to an embodiment of the present invention, a single sheet phased array includes a flexible dielectric substrate having a first surface and an oppositely facing second surface. A first conductive layer is provided on the first surface, and a second conductive layer is provided on the second surface. The flexible dielectric substrate, the first conductive layer and the second conductive layer are patterned to form at least one feed network and a plurality of radiators directly coupled to the at least one feed network. Further, the plurality of radiators are pivotable with respect to the flexible dielectric substrate to be positioned in a direction away from the first surface or the second surface of the flexible dielectric substrate when the single sheet phased array is deployed.

According to the above described embodiments of the present invention, a phased array that is relatively light weight and simple in construction can be provided.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A single sheet phased array comprising:

a flexible dielectric substrate having a first surface and an oppositely facing second surface; and a first conductive layer on the first surface and a second conductive layer on the second surface, wherein the flexible dielectric substrate, the first conductive layer and the second conductive layer are patterned to form at least one feed network and a plurality of radiators directly coupled to the at least one feed network, wherein the at least one feed network comprises a plurality of phase shifters, and wherein the plurality of radiators are pivotable with respect to the flexible dielectric substrate to be positioned in a direction away from the first surface or the second surface of the flexible dielectric substrate when the single sheet phased array is deployed.

2. The single sheet phased array of claim 1, wherein components of the plurality of phase shifters comprise patterned portions of the first conductive layer and the second conductive layer.

3. The single sheet phased array of claim 1, wherein the plurality of phase shifters are offset co-planar waveguide phase shifters.

4. The single sheet phased array of claim 3, wherein components of each of the offset co-planar waveguide phase shifters comprise at least one capacitive component, at least one inductive component and a waveguide.

5. The single sheet phased array of claim 1, wherein the at least one feed network comprises a first feed network and a second feed network.

6. The single sheet phased array of claim 5, wherein a first group of the plurality of radiators is coupled to the first feed network and a second group of the plurality of radiators is coupled to the second feed network.

7. The single sheet phased array of claim 6, wherein a first group of the plurality of phase shifters is coupled to the first feed network and a second group of the plurality of phase shifters is coupled to the second feed network.

8. The single sheet phased array of claim 6, wherein a polarization of the first group of the radiators is different from that of the second group of the radiators.

9. The single sheet phased array of claim 1, wherein the at least one feed network comprises a plurality of branch feeds extending in parallel.

10. The single sheet phased array of claim 9, wherein the plurality of phase shifters are divided into groups, and the phase shifters of each of the groups are serially coupled to each other via a corresponding one of the plurality of branch feeds.

11. The single sheet phased array of claim 1, wherein the plurality of radiators are notch radiators.

* * * * *